US005789697A

United States Patent [19]

Engelke et al.

[11] Patent Number: 5,789,697

[45] Date of Patent: Aug. 4, 1998

[54] COMPACT CHEMICAL ENERGY SYSTEM FOR SEISMIC APPLICATIONS

[75] Inventors: Raymond P. Engelke; Robert O. Hedges; Alan B. Kammerman; James N. Albright, all of Los Alamos, N. Mex.

[73] Assignee: The Regents of the University of California, Los Alamos, N. Mex.

[21] Appl. No.: 726,723

[22] Filed: Oct. 7, 1996

Related U.S. Application Data

[60] Provisional application No. 60/021,163, Jul. 1, 1996.

[51] Int. Cl.[6] ..... F42B 3/10

[52] U.S. Cl. ..... 102/202.5; 102/202.7; 149/89

[58] Field of Search ..... 149/89; 102/202.5, 102/202.7

[56] References Cited

U.S. PATENT DOCUMENTS

| | | | |
|---|---|---|---|
| 3,309,251 | 3/1967 | Audrieth et al. | 149/89 |
| 3,798,092 | 3/1974 | Runge et al. | 149/89 |
| 3,980,510 | 9/1976 | Ridgeway | 149/89 |
| 4,034,672 | 7/1977 | Eckels | 102/313 |
| 4,471,697 | 9/1984 | McCormick et al. | 102/202.5 |
| 4,777,880 | 10/1988 | Beattie et al. | 102/313 |

*Primary Examiner*—Edward A. Miller
*Attorney, Agent, or Firm*—Ray G. Wilson

[57] ABSTRACT

A chemical energy system is formed for producing detonations in a confined environment. An explosive mixture is formed from nitromethane (NM) and diethylenetriamine (DETA). A slapper detonator is arranged adjacent to the explosive mixture to initiate detonation of the mixture. NM and DETA are not classified as explosives when handled separately and can be safely transported and handled by workers in the field. In one aspect of the present invention, the chemicals are mixed at a location where an explosion is to occur. For application in a confined environment, the chemicals are mixed in an inflatable container to minimize storage space until it is desired to initiate an explosion. To enable an inflatable container to be used, at least 2.5 wt % DETA is used in the explosive mixture. A barrier is utilized that is formed of a carbon composite material to provide the appropriate barrel geometry and energy transmission to the explosive mixture from the slapper detonator system.

10 Claims, 3 Drawing Sheets

COMPACT CHEMICAL ENERGY SYSTEM FOR SEISMIC APPLICATIONS

This patent application claims the benefit under 35 USC §119(e) of U.S. provisional application #60/021,163, filed Jul. 1, 1996.

BACKGROUND OF THE INVENTION

This invention is related to seismological devices, and, more particularly to acoustic sources for generating seismological data. This invention was made with government support under Contract No. W-7405-ENG-36 awarded by the U.S. Department of Energy. The government has certain rights in the invention.

Seismology is the science of characterizing the subterranean earth by interpreting the way in which known acoustic waves travel through the various strata and formations in the earth. Seismology is a major tool used by the oil industry to identify new reserves and to better characterize existing reserves. Since the inception of this technology there has been an ongoing search for acoustic sources, receiver/detector devices, and interpretive aids that will maximize the volume and resolution of the rock masses being imaged and minimize the cost and risk required in obtaining this information.

The exponential increase in available computing power in recent years and, particularly, the acquisition of super computers by the major oil companies has vastly increased the ability of seismologists to process and interpret seismic data. This processing ability has also greatly increased the search for improved data and techniques. One of the improved techniques is crosswell tomography, which introduces a seismic source in an existing borehole and places receivers in surrounding boreholes at various depths. If multiple source pulses are then introduced at varying known depths, it is possible to obtain a two-dimensional picture of the earth's structure between the "source" borehole and a "receiver" borehole; if multiple receiver boreholes are present an approximate three-dimensional picture can be obtained. As the amount of acoustic energy available at the source of is increased, the boreholes can be more widely spaced and the volume of earth that can be evaluated increases rapidly with an accompanying reduction in the unit cost of the information.

Over the years, one of the important sources of acoustic energy for seismology has been explosives. While very effective sources of seismic energy, conventional explosives have a number of aspects that can cause concern. Some of these are (1) the administrative complexity of shipping and handling explosive materials, (2) the hazardous nature of accidental and untimely detonation due to careless handling, and (3) in the case of tomography, the difficulty of obtaining a large number of repetitive detonations at different known depths. Another salient problem with explosives is the perception that any explosive is generally dangerous and uncontrollable, no matter what the circumstances surrounding its application.

Accordingly, it is an object of the present invention to provide an explosive seismic source that can be safely handled and shipped.

Another object of the present invention is to provide an explosive seismic source having an explosive mixture formed in a borehole.

One other object of the present invention is to detonate the explosive mixture with a non-explosive initiator.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may be a chemical energy system for producing detonations in a confined environment. An explosive mixture is formed from nitromethane (NM) and diethylenetriamine (DETA). A slapper detonator is arranged adjacent to the explosive mixture to initiate detonation of the mixture. NM and DETA are not classified as explosives when handled separately and can be safely transported and handled by workers in the field. In one aspect of the present invention, the chemicals are mixed at a location where an explosion is to occur.

For application in a confined environment, the chemicals are mixed in an inflatable container to minimize storage space until it is desired to initiate an explosion. To enable an inflatable container to be used, at least 2.5 wt % DETA is used in the explosive mixture. A barrier is utilized that is formed of a carbon composite material to provide the appropriate barrel geometry and energy transmission to the explosive mixture from the slapper detonator system.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

In accordance with the present invention, a chemical energy system is provided to produce detonations in a borehole environment. All of the components of the chemical energy system are non-explosive materials, as classified by the Department of Transportation so that the component shipping and handling can generally be done with no proximate danger. In a preferred embodiment, the chemical components are mixed within a downhole tool so that explosive danger to workers is eliminated. The combination of non-explosive components has been shown to be operable in conditions approximating a borehole environment.

Two non-explosive liquids, nitromethane (NM) and diethylenetriamine (DETA), are known to produce an explosive composition when mixed together. The chemical formulae for NM and DETA are, respectively, ($CH_3NO_2$ and $H_2N(CH_2)_2NH(CH_2)_2NH_2$). While the neat form of liquid NM can be detonated, it is an extremely insensitive explosive, so insensitive that the Department of Transportation defines it as a flammable liquid for the purposes of transporting it within the United States. The amine base, DETA, cannot be detonated in its neat form.

Figure 1:
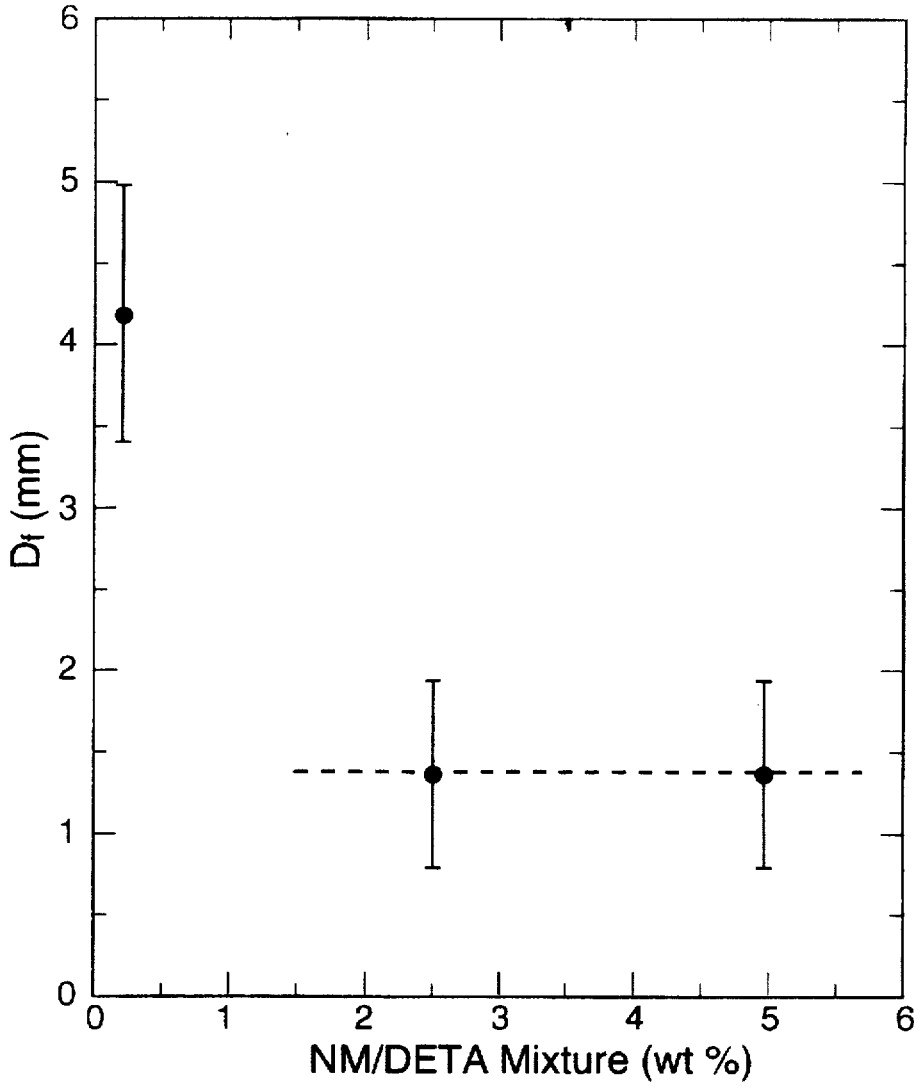
FIG. 1 graphically depicts the failure diameters of NM/DETA mixtures.

It is a remarkable fact that when even small amounts of DETA are added to NM, a significantly more sensitive explosive is produced. As an example of this sensitization, consider the effect of DETA addition on the failure diameter of NM. Note that the failure diameter ($D_f$) of a long right circular cylinder of an explosive is the minimum cylinder diameter in which a steady self-sustaining detonation wave can be propagated. For cylinder diameters smaller than $D_f$, any attempt to generate such a steady wave will fail; i.e., it will result in a shockwave that quickly decays to zero strength. The functional dependence of an NM/DETA-mixture's failure diameter on the amount of DETA present has been previously studied, under some conditions. FIG. 1 shows this dependence for various concentrations of the DETA additive, when the explosives are contained in thick Pyrex cylinders. With sufficient additive (ca. 2.5 wt %), the failure diameter can be reduced by over an order of magnitude; increasing the DETA concentration beyond 2.5 wt % does not further decrease $D_f$.

The following exemplary discussion is based on a system where the energy released per explosion is ca. 0.5 kcal. The heat of detonation ($\Delta H_{det}$) of NM is ca. 1.23 kcal/g and its mass density ($p_0$) is 1.13 g/Cm$^3$ at ambient temperature. Note that the heat of detonation of an explosive is the difference of the enthalpy of its undetonated form (i.e., $CH_3NO_2$ for NM) and that of the chemical reaction products generated by its detonation (i.e., $N_2$, $H_2O$, CO, $CO_2$, etc.). These values of $\Delta H_{det}$ and $p_0$) suggest a charge volume of ca. 0.5 cm$^3$.

A preferred charge geometry is a long right circular cylinder; this allows the detonation wave to reach steadiness and, thus, emit a highly reproducible acoustic signal. If the borehole tool is to be a valuable device, it must be able to fire a large number of shots during one trajectory in the wellbore. The container materials for these shots must be stored in the small volume within the tool.

One efficient method of storing the containers would be in a deflated condition; injection of the explosive mixture into the inflatable/collapsed container at shot time would then cause inflation. Inflatability of the containers can be obtained by using a strong pliable material, e.g., a plastic suitable filling tube preferably prevents shock initiation back into the separate storage containers, e.g., by using a conventional detonation trap. A reasonable aspect ratio of such an inflated plastic cylinder would be one with a length five times its diameter. This aspect ratio ensures detonation-wave steadiness for most of the detonation process. These considerations imply that the plastic-enclosed cylinder of explosive should be approximately 5-mm diameter×25-mm long.

The failure diameter of an explosive is dependent on the character of the material in which it is contained; this is called the effect of confinement. High mass-density/high sound-speed confining materials are best for producing a small failure diameter, other things being equal. This is because such confinement reduces the amount of work the explosive does in directions lateral to the detonation shock-wave direction. Plastics are inferior confiners; i.e. they give large $D_f$ values when used as containers (see Table A).

TABLE A

Failure Diameter of NM vs Confinement

| Confinement Material | Failure Diameter (mm) | Acoustic Impedance |
|---|---|---|
| Stainless Steel (304) | 1.9 ± 0.5 | 36.1 |
| Brass (330) | 2.3 ± 0.8 | 31.5 |
| Pyrex | 16.2 ± 0.4 | 8.7 |
| Polyvinylchloride | 22.3 ± 1.6 | 2.7 |

Note, from Table A, that neat NM confined in polyvinylchloride (PVC) plastic has a failure diameter of 22.3±1.6 mm. It is, therefore, impossible to propagate a steady detonation wave in NM contained in a PVC tube that has an i.d. of 5 mm. For plastic tubes of this diameter, an NM/DETA mixture is selected to produce a failure diameter $D_f$ significantly smaller than 5 mm when fired in PVC.

The PVC $D_f$ for NM of 22.3 mm suggests an NM/DETA mixture that reduces this value by about a factor of ten. The $D_f$ results presented in FIG. 1 show that adding 2.5 to 5 wt % of DETA to NM produces an explosive with a $D_f$ about ten times smaller than NM when fired in Pyrex. The failure diameter of pure NM under these conditions is ca.16.2 mm. This suggests a 95/5 wt % NM/DETA material for use in the borehole application; the 5 wt % sensitizer composition was chosen to err on the side of extra sensitizer.

The measured $D_f$ of the 95/5 wt % NM DETA mixture is $$D_f=2.5+0.5 \text{ mm},$$

when fired at 24.5±0.5° C. in PVC plastic. This result shows that, insofar as failure diameter effects are concerned, it is possible to use the 95/5 wt % NM/DETA mixture in a 5-mm i.d. plastic tube for the borehole application.

The detonation of the 95/5 wt % NM/DETA must be initiated in a manner suitable for borehole application. Usually in research on explosives as insensitive as NM and the NM/DETA mixtures, a more sensitive solid explosive is used to cause initiation. This is not suitable in the borehole tool and a method of initiation is required that does not utilize other explosives.

Figure 2:
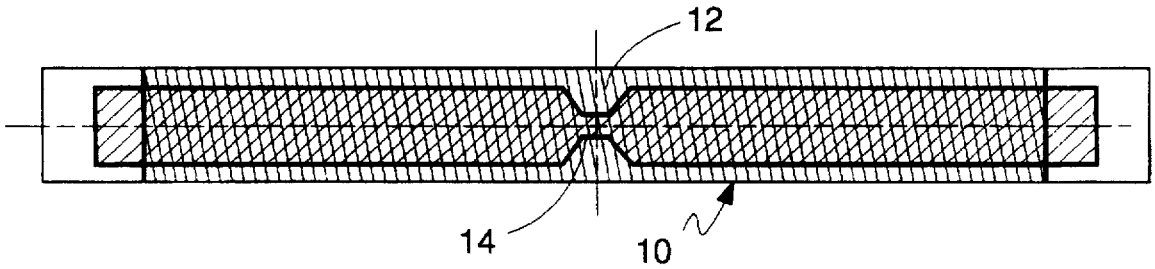
FIG. 2 is a cross-section view of a typical slapper detonator.

A detonation initiation technique that uses only electrical means is a slapper detonator system, using thin plastic (Kapton) "flyers", traveling at high speed, to produce the initiation shock in the explosive to be detonated. See, e.g., U.S. Pat. No. 4,471,697, issued Sep. 18, 1984, and incorporated herein by reference. The Kapton flyers are accelerated to speed by electrically bursting a thin copper "bridge" in contact with the flyer. The bridge is burst (i.e., turned into a plasma) by triggering a spark gap that very rapidly transfers the energy stored in a capacitor discharge unit (CDU) into the slapper circuit. A CDU having a value of 12.5 μF was used for the exemplary results herein. FIG. 2 is a drawing of a slapper detonator 10. For the plasma to do work on Kapton flyer 12, there must be a void space adjacent to the flyer. This region is termed a "barrel" in analogy to the barrel of a gun. In order for the plasma to do work preferentially on flyer 12, a relatively massive "tamper" is placed on the opposite side of the bridge from flyer 12.

A preferred design "slaps" as much of the cross-sectional area of the NM/DETA mixture as possible to maximize the volume of the explosive mixture that is raised to high pressure by the impact with the flyer. Note that the cross-sectional area of flyer 12 thrown by the bridge burst is determined by the bridge 14 cross-sectional area; larger area bridges throw larger area flyers and flyer 12 shape mirrors bridge 14 shape. The thickness of flyer 12 thrown by bursting bridge 14 is related to how long high pressure is maintained in the explosive by flyer 12. Maintaining the shock pressure longer requires thicker flyers, but thicker flyers are not thrown at as high a speed as thin ones, other things being equal. Higher flyer speed produces higher pressure in the struck material. Fairly thick flyers with Kapton thickness of 1 to 3 mils were selected as a good compromise between the production of high pressure in the explosive and the time duration this pressure would be maintained.

In actual use, the explosive assembly will be exposed to the static pressure caused by the fluid in a wellbore. This means that a barrier must be placed between the liquid explosive and the barrel to maintain the free space in the barrel. The barrier material must be very strong to resist the highest wellbore pressures. Another consideration for choosing the barrier material was the maximum allowable acoustic impedance for the composite. As can be shown from functional relationships for the fraction of the reflected shock energy and the fraction of the transmitted shock energy into a different contiguous medium, choosing a barrier material having an acoustic impedance close to that of the sensitized liquid explosive will increase the shock energy transmitted into the explosive mixture when the flyer impacts the barrier, thus increasing the probability of initiating the mixture.

Figure 3:
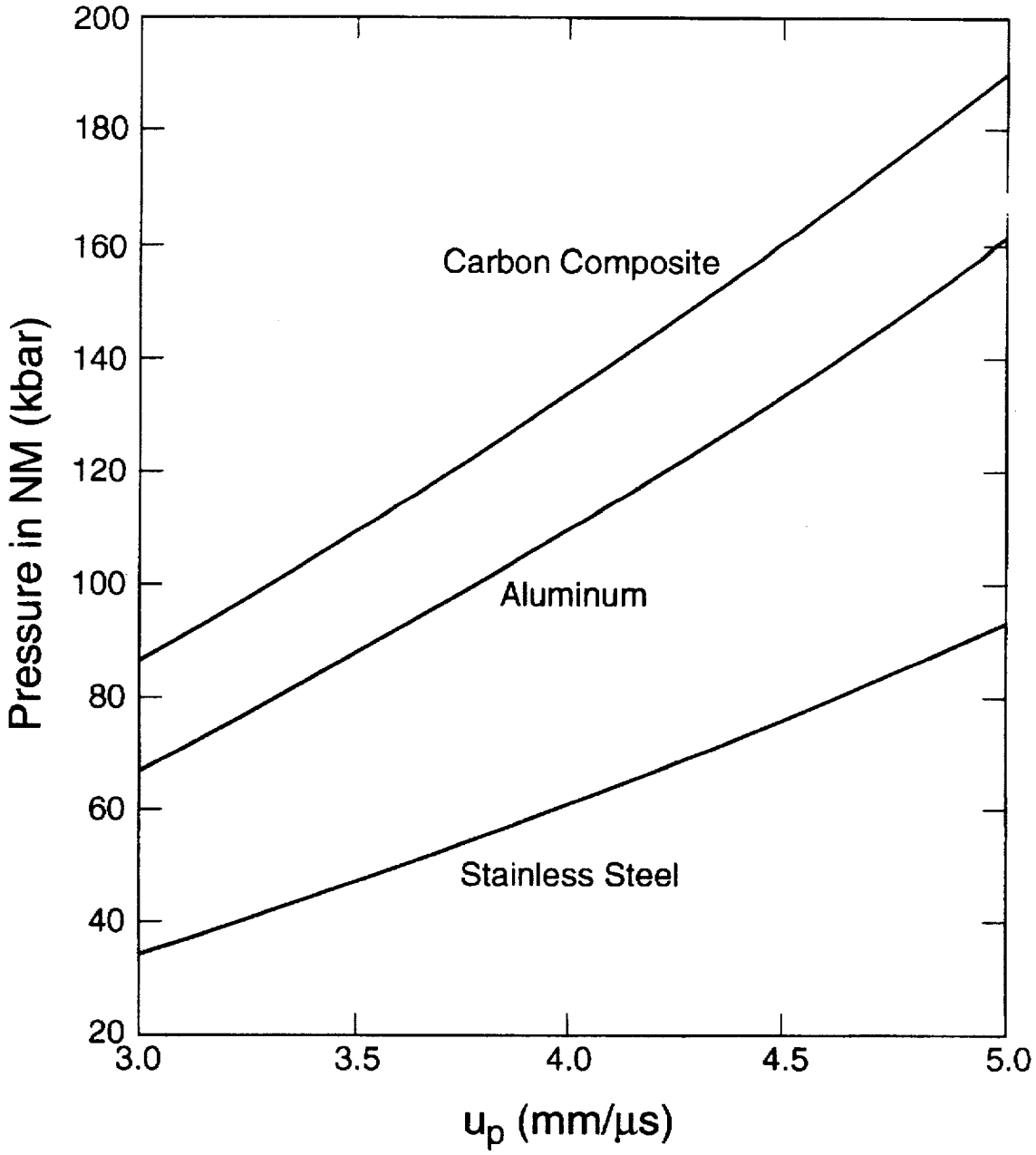
FIG. 3 graphically depicts the pressure generated in the NM-based explosive mixture through various barrier materials.

Three types of barrier materials were investigated; stainless steel, a carbon composite, and aluminum. FIG. 3 shows the results of the calculations; i.e., the pressure generated in the NM-based explosive: (1) as a function of the Kapton flyer before the collision with the barrier and (2) as a function of the barrier material. As a specific example of the superiority of the carbon composite material as a barrier, consider the pressure in the explosive generated by a flyer moving at 4.0 mm/ps at the instant of impact. In this case, the pressures generated in the liquid explosive are ca. 132, 107, and 60 kbar for the carbon composite, aluminum, and stainless steel barriers, respectively (see FIG. 3). The stainless steel barrier yielded less than one-half the pressure transferred by the carbon-composite material. Under the same conditions, the aluminum barrier gave a pressure in the explosive down by ca. 25 kbar relative to the carbon-composite barrier. Even this pressure difference is very significant because the initiation of the explosive must take place very rapidly in the present system, if it is to occur at all.

Various configurations of carbon composite were tested to establish the best trade-off properties. Thin membranes of composite were constructed with layers of carbon fibers at various angles to each other and bonded together with cured resin. The greater the number of layers of fibers, the stronger and thicker the barrier membrane becomes. Also, when there are a greater number of layers at smaller angles to each other, the resulting membrane is flatter; a thin two-layer membrane has considerable natural "curl". In the subject application, the membrane needs to be as thin as possible while providing strength to withstand the hydrostatic pressure and also providing surface integrity to physically contain the liquid explosive.

One sample (designated as "A") consisted of four carbon-composite (CC) plies woven and bonded together with a 0, 90, +45, −45° fiber orientation. A 1-mil thick Mylar layer was bonded to this laminate; the resultant compressed material was ca. 12-mils thick. The following materials were utilized in the construction: (1) 3-mil thick Thornel T300 carbon fibers, (2) DOW-332 room curable epoxy, and (3) Jefferson Chemical T-403 epoxy curing agent.

A second sample (designated as "B") had a two ply 0, 90° fiber orientation and was manufactured from PEEK unidirectional tape, 5 mils in thickness; the resultant material was ca. 11.5-mils thick. The primary material used in its fabrication was carbon reinforced thermoplastic, APC-2, made by ICI Composites, Inc.; it is an IM-6 carbon fiber/polyetheretherketone (PEEK) unidirectional tape. PEEK is very resistant to degradation in solvents; i.e., it should not degrade in a wellhose fluid under high temperature and pressure. The two-ply material was molded at 390° C. for two hours, held under compression and cooled to room temperature. Note that no Mylar was used in material B.

The type A material was constructed with the Mylar layer, because it was found that gaps between fibers in the carbon composite not filled with resin would result in liquid leaking through the barrier. However, it was determined that care in fabrication and inspection on a light table would yield material without gaps. Type A material was found to have a burst pressure of ca. 375° psig maximum, while type B was burst tested to ca. 720° and 860° psig.

Samples of type A and B were chosen for detonation testing. The barriers used in testing were 0.50-inch outside diameter and were laser cut to prevent delamination of layers that can occur when the material is cut with a shearing or sawing type tool.

Use of the carbon-composite (CC) barrier significantly increases the problem of initiating the NMIDETA mixture. One parameter to alter to improve the system was the Kapton flyer thickness. Increasing the flyer thickness increases the length of time high pressure is maintained in the explosive. Since the thicker flyer is more massive, it will, however, be moving at a lower speed when it collides with the barrier.

Significant improvement in performance was obtained with 3-mil thick flyers. Subsequently, 5-mil thick flyers were tested. The 5-mil slapper detonators did not perform properly with the power supply used for the 3-mil slappers; a larger capacitance unit is needed to burst them properly. Therefore, further testing was based on use of the 3-mil-thick-flyer slappers.

Testing was then directed at initiating the NM/DETA mixture with a CC barrier present, but confined in PVC plastic. The barrel length was increased to 62 mils and detonation was achieved in PVC confinement with the A-type barrier in place. A bridge width of 6 mm was used. The critical voltage for initiating the explosive is in the range 7.5±0.5 kV. In experiments, with 31-mil long barrels, 3 mm-wide bridges, and A barriers, detonation was obtained with the CDU voltage as low as 7.5 kV.

Testing was then done with the B-type barrier because of its measured burst strength and the simplicity of its construction. Also, the higher flyer speed achieved with the 3-mm wide bridge slapper was useful. This slapper configuration was used in the remaining work.

Testing showed that the critical voltage for producing initiation in PVC with the B-type barrier in place and a 31-mil long barrel was <6 kV. With a 62-mil long barrel, the threshold voltage is in the range 4.25±0.75 kV; i.e., detonation occurs at 5.0 kV and failure occurs at 3.5 kV. Detonation could be reliably produced in this assembly with the B-type barrier in place and with the explosive confined in PVC plastic.

The PVC confinement used in the experiments described above had a ca. 5-mm thick wall. Use of this material is not possible if the explosive containers are to be inflatable. A candidate material for use in the tool is thin-walled Teflon. Teflon FEP film has an acoustic impedance greater than PVC. Thus, if a given slapper-barrier system will initiate the NM/DETA mixture in PVC, it should be able to do so in Teflon also. Since a Teflon film was to be used, the foregoing statement assumes that the wall thickness is irrelevant for the PVC and Teflon materials being used. FEP-Teflon tubes (baggies) with ca. 2.5-mil thick walls thermoformed by Welsh Fluorcarbons, Inc. were obtained. Such tubes can be stored in a "crushed" form in the tool and then inflated by filling them with the liquid explosive immediately before use. This design mitigates the storage problems associated with the tool's small internal volume.

Experiments showed that detonation with this type assembly occurs when a 12 μF CDU is charged to 7.5 kV. Testing showed that with Teflon film containers and with the detonation system described immediately above, the threshold voltage for detonation was 4.63±0.13 kV.

Yet other experiments were done to determine whether the slapper detonator would be subject to electrical arcing problems when it is fired submerged in water. Two assemblies were built with the Teflon baggy replaced by a 10-mil thick aluminum witness plate. The witness plates indicated that the flyers were properly thrown and no arcing was evident on the recovered flat cables when the assembly was submerged in tap water.

In the design of a downhole tool, such as the proposed seismic source that will be used in a wellbore of any significant depth, there are a number of critical environmental factors that must be considered. The most important of these are: (1) the increasing temperature with depth in the wellbore; (2) the increasing hydrostatic pressure with depth due to the presence of the wellbore fluid; and (3) the fact that fluids, and even gases, encountered in a wellbore will probably be corrosive.

For the high pressure, high temperature tests, the basic design of the slapper was 0.7-mil thick copper, 0.625-inches wide and 10-inches long with a 0.125-inch-square bridge at the center. This copper was laminated between a layer of 3-mil Kapton on each side so that a 0.500-×0.625-inch electrical contact area was left exposed at each end. The copper was insulated by at least 0.25 inch of laminated Kapton at all edges. On one side of the slapper a 0.500-inch diameter by 0.010-inch thick stainless-steel tamper was centered over the bridge area and bonded to the Kapton with Hysol 9340 epoxy. Hysol 9340 epoxy was used for all bonds in this assembly and was chosen because it maintains bond strength to a temperature of 150° C. On the opposite side of the slapper, a barrel was centered over the bridge area and bonded. The barrels used were approximately 0.500-inch outside diameter and 0.250-inch inside diameter. Barrel length was initially fixed at 0.064 to 0.070 inch depending on Viton material thickness; barrel lengths up to 0.159 inch were later tested. These longer barrels were constructed by building up layers of Viton or of metal and Viton. In all cases, the top layer (the layer bonded to the barrier) of the barrel was Viton. These multiple layers were bonded together with the Hysol 9340 epoxy. Next, the barrier, a 0.500-inch diameter by 0.012-inch thick 2-layer carbon composite disk (type "B" defined above), was bonded to the barrel. The tube that confined the NM/DETA mixture was Teflon tubing of 0.250-inch inside diameter, 0.032-inch wall thickness, and 0.550-inch length. This piece of tubing was supported by a washer of neoprene tubing that was 0.312-inch inside diameter, 0.500-inch outside diameter, and 0.19-inch length. The glued assembly was cured in an oven at the minimum recommended temperature of 60° C. for at least two hours. In addition, assemblies were not used for tests for many days after fabrication, so that complete cure of the adhesive was assured.

For functional testing, the Teflon tube was filled completely with the NM/DETA mixture. Particular attention was required to ensure that no air bubbles were trapped in the NM/DETA. If there were a bubble in the liquid and the orientation of the explosive assembly allowed that bubble to rise against the barrier, the explosive liquid would not initiate because the full energy of the flyer would not be transferred effectively to the liquid surface. A polyethylene cap was placed over the open end and sealed with Devcon 1-minute epoxy. It was discovered in early tests that the polyethylene cap was deforming at 120° C. For all remaining tests at 120° C., aluminum covers were fabricated and used.

Tests were started based on a test matrix, that would continuously increase the temperature and then the pressure toward a maximum of 6400 psig at 120° C. with five tests at each step of the matrix. Prior to beginning the tests as defined by the matrix, numerous tests were performed to check out and validate the test set-up. Tests were first conducted to confirm that the pressure system would attain the maximum required pressure and hold that pressure for a reasonable time. The capacitor discharge unit (CDU) was set up near the pressure chamber. The high-voltage power supply for charging the CDU, the firing control console, and necessary instrumentation were set up in an adjacent room to ensure personnel safety during the actual firing in the pressure chamber. Bare slappers and then complete explosive assemblies were fired in air through the principal feedthru to establish the baseline firing voltage to be used. This voltage was established at 5750 volts. This voltage was established to be as low as practical, but high enough to be confident that slapper operation would be correct.

It was expected that the explosive mixture would function properly at the high temperatures that were specified in the test matrix, but because the effect of high pressure on the explosive/mechanical system performance was less well understood, many tests were done out of the sequence. Some ambient temperature, high pressure firings were attempted early in the test series.

Figure 4:
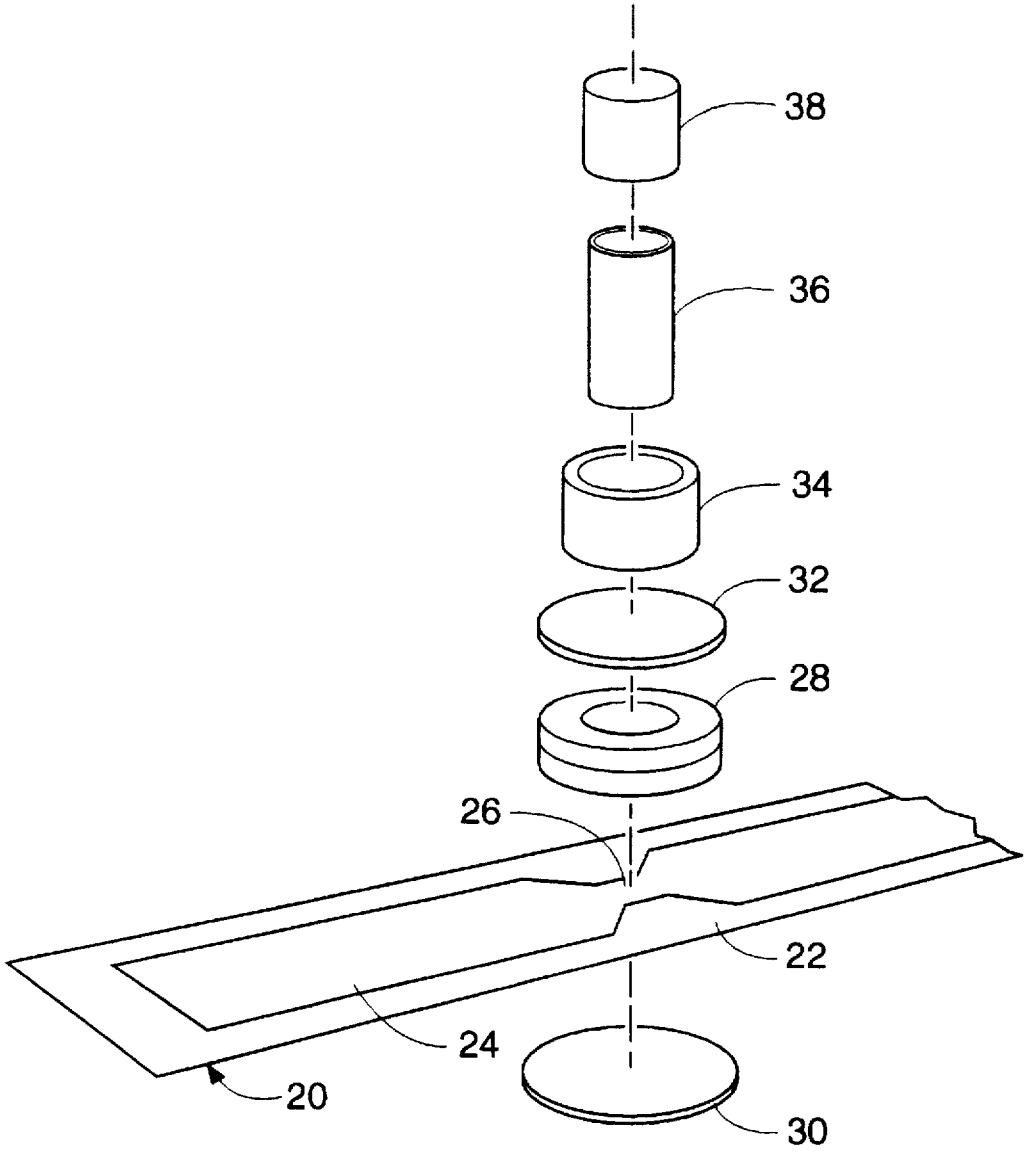
FIG. 4 is a pictorial illustration of a chemical energy system for producing a detonation according to the present invention.

Table B is a complete collection of the firing-test results obtained in high pressure/temperature experiments. The experiments used the following hardware configuration as shown in FIG. 4:

| | |
|---|---|
| Slapper 20 | 3 mils thick Kapton 22, 0.7 mils thick, copper 24, 125 mils square bridge 26. |
| Barrel 28 | 62 mils long × 200–250 mils inside diameter. |
| Tamper 30 | 500 mils diameter × 10 mils thickness, stainless steel |
| Barrier 32 | two layers CC, 0°–90, 12 mils thick. |
| Mix Confinement 36 | Teflon tube 250 mils ID, 32 mils wall thickness in a neoprene hose 34. The tubes were capped with polyethylene caps, except experiments No. 551–560 used aluminum caps 38. |
| Mix | 95/5 cut % NM/DETA mixture; mass of 0.5 grams. |

Ambient temperature was in the range of 20° C. to 38° C. All 70-mil barrels are single-layer Viton. Numbers followed by "R" indicate 2-layer Viton; M/R indicate 1-layer metal, 1-layer Viton. The pressure media used were tap water ($H_2O$) or ethylene glycol (EG).

Testing was divided into two groups. The division of the tests was required because of the boiling point of the explosive liquid, which is less than 100° C. at the test altitude. The first and largest group was all tests that could be completed at or below 90° C. The second group was those tests that were completed at 120° C. and which required a more elaborate test set-up using a circulation pump and secondary reservoir of 150° C. ethylene glycol.

The results of the first group of tests are tabulated as S1 thru S46 in Table B. There are missing test numbers in this table. The missing tests were deflection tests. Note also that some of the tabulated tests did not contain explosives. These non-explosive tests were slapper/barrel/barrier-only assemblies in which slapper performance was estimated by examination of debris or they were standard assemblies that were filled with colored water, taken to a specified pressure, and then inspected for leaks due to deflection induced cracking of adhesive joints. Tests S1 thru S6 were shakedown tests to familiarize personnel with the test setup and to sort out problems. Tests S7 thru S26R were an attempt to establish a possible upper operating pressure limit that could help direct the test effort away from unnecessary tests. The maximum pressure at which detonation was obtained was 2000 psig (tests S25R and S26R). These two test specimens were assembled with particular care and were pre-pressure tested to establish that they would not be damaged by deflections during pressurization.

Tests S27 thru S31 were tests at ambient pressure at approximately 60° C. and 90° C. These tests indicated that higher temperatures were not a problem as long as the explosive mixture was not exposed to the higher temperatures for long periods of time.

Tests S35 thru S46 were further tests to establish upper pressure limits.

This group of tests indicates that the chosen explosive and the confinement/initiation system will readily function up to 90° C. and, if special care is taken in assembly, will also function at static pressures up to 2000 psig.

The second group of tests is tabulated as S47 thru S60 in Table B. All of these tests were done by first raising the system pressure to a range between 200 and 500 psig and then circulating the 150° C. ethylene glycol from the reservoir into the test chamber to obtain a firing temperature of 120° C.

Tests S47 thru S50 were again shakedown tests for the modified test set-up. Also, it was learned from these tests that the polyethylene cap being used to close the explosive assembly was changing shape as the temperature exceeded 100° C. and the explosive mix was being diluted with water, resulting in failure.

Tests S51 thru S60 were performed using an aluminum cap to close the explosive assembly. This resulted in three detonations at or above 120° C. and one at 112° C. However, there were six tests in this group that were failures; five of which were due primarily to non-explosive system failures.

There were eleven deflection tests performed. These tests did not provide quantitative results, but they yield a very strong indication that deflection and deformation of the slapper/barrel/barrier assembly can become a problem as hydrostatic pressure increases.

A detonation system is described herein that is fabricated by mixing two non-explosive materials; here "non-explosive" means a material that DOT regulations define as such. The two materials are the liquid organic compound nitromethane (NM) and the organic base diethylenetriamine (DETA). The composition used here is 95/5 wt % NM/DETA.

It was demonstrated that this explosive can be initiated by an electrical slapper detonator system which utilizes no chemical explosives. The energy release per detonation can range from ca. 0.5 kcal to an arbitrarily large amount.

A major technical difficulty to overcome in producing this explosive system is to achieve initiation of the explosive with a slapper detonator across the container (barrier) in which the explosive is enclosed. A container (barrier) is required to maintain the slapper barrel geometry against the hydrostatic head experienced within wellbores. Metals are not strong candidates as barrier materials because of their large shock impedance mismatch with organic compounds. Because of this, a carbon-fiber material was selected as an appropriate barrier material.

The results shown in Table B demonstrate that the explosive system according to the embodiment is adequate to function properly under pressures as high as those found in water-filled wellbores <4,600 ft deep. The restriction on wellbore depth results from deflection, distortion, and loss of integrity of the barrier/barrel assembly. These factors cause shortening of the barrel, non-planarity of the surface the slapper flyer impacts, and even admission of wellbore fluid into the barrel volume.

The tests also showed that the explosive mixture is capable of performing satisfactorily at wellbore temperatures as high as 120° C. This is in spite of known evidence that the 95/5 wt % NM/DETA mixture degrades over time and that this degradation accelerates as temperature increases. The testing showed that detonation can be achieved after three minutes at 120° C. Since the actual seismic source would mix and initiate the explosive within times significantly less than one minute, temperatures of <120° C. do not cause difficulties.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A chemical energy system for producing detonations in a confined environment, the energy system comprising:

an explosive mixture of nitromethane (NM) and diethylene-triamine (DETA);

a container for confining said explosive mixture;

a slapper detonator arranged to initiate detonation of said mixture; and a barrier formed of a carbon composite material for sealing said container and for transmitting energy from said slapper detonator to said explosive mixture.

2. A chemical energy system according to claim 1, wherein said mixture includes at least about 2.5 wt % DETA.

3. A chemical energy system according to claim 1, wherein said mixture includes about 2.5 wt % to 5 wt % DETA.

4. A chemical energy system according to any one of claims 1–3, wherein said container is an inflatable container.

5. A chemical energy system according to claim 4, wherein said inflatable container defines a right circular cylinder when inflated with said explosive mixture.

6. A chemical energy system according to claim 5, wherein said right circular cylinder has a length dimension about five times the diameter dimension.

7. A chemical energy system according to claim 1, wherein said mixture is formed with an amount of DETA effective to result in a maximum failure diameter less than 5 mm.

8. A chemical energy system according to claim 1, wherein said slapper includes a flyer portion having a thickness of at least 3 mils.

9. A chemical energy system according to claim 4, wherein said mixture is formed with an amount of DETA effective to result in a maximum failure diameter less than 5 mm.

10. A chemical energy system according to claim 9, wherein said slapper includes a flyer portion having a thickness of at least 3 mils.

* * * * *

UNITED STATES PATENT AND TRADEMARK OFFICE

CERTIFICATE OF CORRECTION

PATENT NO. : 5,789,697

DATED : August 4, 1998

INVENTOR(S) : Engelke, et al.

It is certified that error appears in the above-identified patent and that said Letters Patent is hereby corrected as shown below:

Column 5, line 31, after "flyer" insert --speed--.

Signed and Sealed this

Twenty-third Day of February, 1999

*Attest:*

Q. TODD DICKINSON

*Attesting Officer*

*Acting Commissioner of Patents and Trademarks*